US005120497A

United States Patent [19]

Sayashi et al.

[11] Patent Number: 5,120,497

[45] Date of Patent: Jun. 9, 1992

[54] TI-A1 BASED LIGHTWEIGHT-HEAT RESISTING MATERIAL

[75] Inventors: Mamoru Sayashi, Yokohama; Tetsuya Shimizu, Nagoya, both of Japan

[73] Assignees: Nissan Motor Co., Ltd., Kanagawa; Daido Tokushuko K.K., Aichi, both of Japan

[21] Appl. No.: 567,503

[22] Filed: Aug. 15, 1990

[30] Foreign Application Priority Data

Aug. 18, 1989 [JP] Japan ..... 1-213702

[51] Int. Cl.[5] ..... C22C 14/00

[52] U.S. Cl. ..... 420/418; 148/421; 148/549; 420/417; 420/421

[58] Field of Search ..... 420/417, 418, 421; 148/11.5 F, 421

[56] References Cited

U.S. PATENT DOCUMENTS

| | | | |
|---|---|---|---|
| 4,661,316 | 4/1987 | Hashimoto et al. | 420/418 |
| 4,836,983 | 6/1989 | Huang et al. | 420/421 |
| 4,983,357 | 1/1991 | Mitao et al. | 420/418 |

FOREIGN PATENT DOCUMENTS

| | | |
|---|---|---|
| 3243234 | 10/1988 | Japan . |
| 1255632 | 10/1989 | Japan . |
| 8901052 | 2/1989 | World Int. Prop. O. . |

OTHER PUBLICATIONS

Sastry et al Met. Trans. 8A (1977) 299.

Binary Alloy Phase Diagrams, vol. I Editor-in-Chief: Massalski, ASM, 1986, 175.

*Primary Examiner*—Upendra Roy

*Attorney, Agent, or Firm*—Sughrue, Mion, Zinn, Macpeak & Seas

[57] ABSTRACT

A Ti-Al based lightweight-heat resisting material containing 30 to 42 wt % of Al, which is improved in oxidation resistance by coexistence of 0.1 to 2 wt % of Si and 0.1 to 5 wt % of Nb.

4 Claims, 3 Drawing Sheets x200 x200

TI-AL BASED LIGHTWEIGHT-HEAT RESISTING MATERIAL

BACKGROUND OF THE INVENTION

1. Field of the Invention

This invention relates to a Ti-Al based lightweight-heat resisting material and, more particularly to the improvement in its oxidation resistance.

2. Description of the Prior Art

In recent years, high-speed reciprocating members such as an engine valve, a piston, a rocker arm and the like, or high-speed rotating members such as a turbine blade of a gas turbine or a jet engine, a turbo charger rotor and the like come to be required more and more to have lightness and heat resistance with the improvement of the engine into the high-powered and highly efficient type. According to the requirements, many studies and development of materials for such members have been done actively.

At the present time, Ni-based superalloys are used mainly as materials for said high-speed moving members, besides titanium alloys or ceramic materials are used, however said Ni-based superalloys and ceramic materials have a weakpoint in that they lack reliability as a material for said members because said Ni-based superalloys have a disadvantageous point that they are heavy in weight and said ceramic materials are inferior in the toughness.

Therefore, Ti-Al based materials mainly consisting of an intermetallic compound Ti-Al have been attracted interest lately. Said Ti-Al based materials are superior to the Ni-based superalloys in the lightness and also surpass the ceramic materials in the toughness, however the Ti-Al based materials have a weakpoint of being inferior in the oxidation resistance, accordingly the fact is that they have not been put into practical use as yet.

SUMMARY OF THE INVENTION

The invention was made in view of the aforementioned problem of the prior art, it is an object to provide a Ti-Al based lightweight-heat resisting material having excellent oxidation resistance as well as the lightness and the toughness.

The construction of the Ti-Al based lightweight-heat resisting material according to this invention for attaining the aforementioned object is characterized by containing 30 to 42% of Al, 0.1 to 2% of Si, 0.1 to 5% of Nb by weight percentage and the balance being substantially Ti.

DETAILED DESCRIPTION OF THE INVENTION

The inventors have tried to make an experiment to add Si and Nb independently into the Ti-Al based material in a process of this invention. As a result of the experiment, it was found that oxidation resistance of the Ti-Al based material is improved by addition of Si or Nb, however a degree of the improvement of the oxidation resistance is not satisfactory completely. Namely, an oxidation gain of the Ti-Al based material is merely reduced to one-third as compared with that of the Si-free material by containing Si up to 3% independently. And the oxidation gain of the material is merely improved into one-fourth as compared with that of the Nb-free material by containing Nb up to 1% independently.

Then, the inventors have tried to make Si coexist with Nb, and it was found that the oxidation resistance of the Ti-Al based material is improved remarkably by synergistic effect owing to the coexistance of Si with Nb. This invention was accomplished in accordance with such knowledge. The main point of the invention was to add these elements within a prescribed range in the Ti-Al based material as described above.

Although it is not yet clear that the detailed reason whey the oxidation resistance of the Ti-Al based material is improved remarkably by the coexistence of these elements, it is confirmed phenomenally that the thickness of an oxide film formed on the surface of the Ti-Al based material containing Si and Nb decreases remarkably as compared with a case in which these elements are not contained in the material.

Figure 1A:
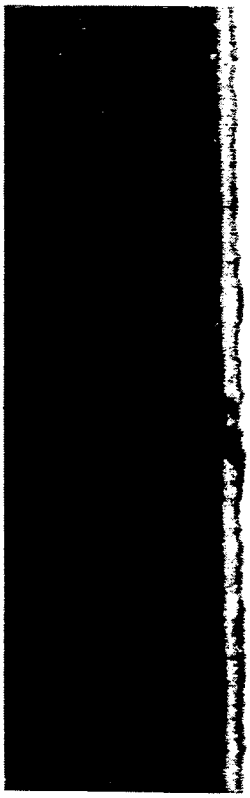
FIG. 1(*a*) and FIG. 1(*b*) are photomicrographs showing microstructures of a Ti-Al based material according to this invention and a conventional Ti-Al based material comparatively.
Figure 1B:
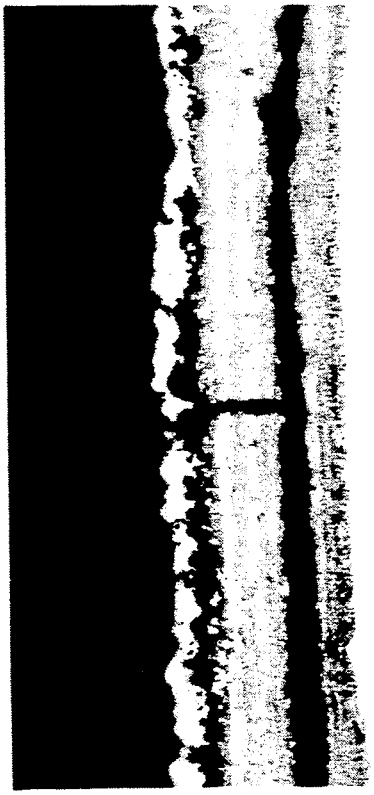

For example, FIG. 1(*a*) shows a microphotograph at the outer layer of the Ti-Al based material in case where 1% Si and 1% Nb are added into the Ti-Al based material containing 33.5% of Al, and FIG. 1(*bl*) shows a microphotograph at the outer layer of the Ti-Al based material free from Si and Nb. It is clear from comparison between the figures that the thickness of the oxide film can be decreased remarkably by addition of both elements Si and Nb.

In addition to the above, it is also confirmed that the oxide film formed on the Ti-Al based material containing Si and Nb (the oxide film shown in FIG. 1(*a*)) is difficult extremely to scale off from the surface of the material as compared with the oxide film in the case where these elements are not contained (the oxide film shown in FIG. 1(*b*)), and it seems that these are the reason why the oxidation resistance of the Ti-Al based material is improved.

The reason why the chemical composition of the Ti-Al based material according to this invention is limited will be described below in detail.

Al: 30 to 42 wt %

Al is an element forming an intermetallic compound together with Ti, it is necessary to contain not less than 30%. When the Al content is less than 30%, $Ti_3Al$ is formed too much, and the ductility and the toughness of the material at the room temperature are degraded, further the oxidation resistance of the material is deteriorated. Said $Ti_3Al$ improves the cold ductility so far as it exists in proper quantity, however $Ti_3Al$ brings deterioration of said characteristics when it exists more than the proper range.

The other side, when the Al content is more than 42%, $Al_3Ti$ is formed in large quantities and the cold ductility and toughness are degraded.

Accordingly, in this invention the Al content is limited to a range of 30 to 42 wt %. In addition, the range of 31 to 36 wt % Al is more preferable.

Si: 0.1 to 2 wt %

Si is an indispensable element for improving the oxidation resistance. The oxidation resistance is improved sharply by making the Si content not less than 0.1% in the coexistence of Nb according to the synergistic effect of Si and Nb. However, it is impossible to obtain the same effect when the Si content is less than 0.1%.

In contrast with this, silicides are formed in abundance and the cold ductility and toughness are degraded by containing Si more than 2%.

For this reason, Si is contained within a range of 0.1 to 2 wt % in this invention. However, the range of 0.2 to 1 wt % is more preferable in regard to the Si content.

Nb: 0.1 to 5 wt %

Nb is an element for improving the oxidation resistance similarly to Si. It is necessary to contain 0.1% of Nb at least. When the Nb content is less than said value, it is impossible to obtain the sufficient effect for improving the oxidation resistance.

Although the oxidation resistance is improved accordingly as the Nb content increases, the effect of Nb is almost saturated at the content of 5%. Therefore, the upper limit of the Nb content is defined as 5%. When Nb is contained in an amount of more than 5%, the specific gravity of the Ti-Al based material becomes larger because the density of Nb is considerable large as compared with that of Al or Ti. Accordingly, an advantage of the Ti-Al based material is deadened, which is originally characterized by the lightness. In addition to above, a disadvantage occurs that the cost of the raw material increases by addition of a large quantity of Nb which is very expensive. And the preferably range of the Nb content is from 0.1 wt % to 2 wt %.

EXAMPLE

Examples of the Ti-Al based lightweight-heat resisting material according to this invention are described below together with comparative examples in order to make clear the characteristics of this invention.

By using sponge titanium and high purity granulated aluminum as raw materials, Ti-Al based materials were melted in an atmosphere of Ar using a plasma skull crucible furnace, and 100 mm diameter 15 Kg-ingots having chemical composition shown in Table 1 were obtained. The respective ingot was subjected to heat treatment at 1300° C. for 24 hours and cooled in a furnace, from which a specimen of 3 mm (thickness×10 mm (width)×25 mm (length) was cut out. The specimen was subjected to a following oxidation resistance test. Results are also shown in Table 1.

OXIDATION RESISTANCE TEST

Method: measuring an oxidation gain caused by cooling down after heating up to 900° C. repeatedly Testing apparatus: kanthal furnace with thermoregulator Testing condition: 900° C./96 hours (heating time)

Number of repetitions for heating and cooling: 192 cycles

Atmosphere: synthetic air of which dew point is 20° C.

Figure 2:
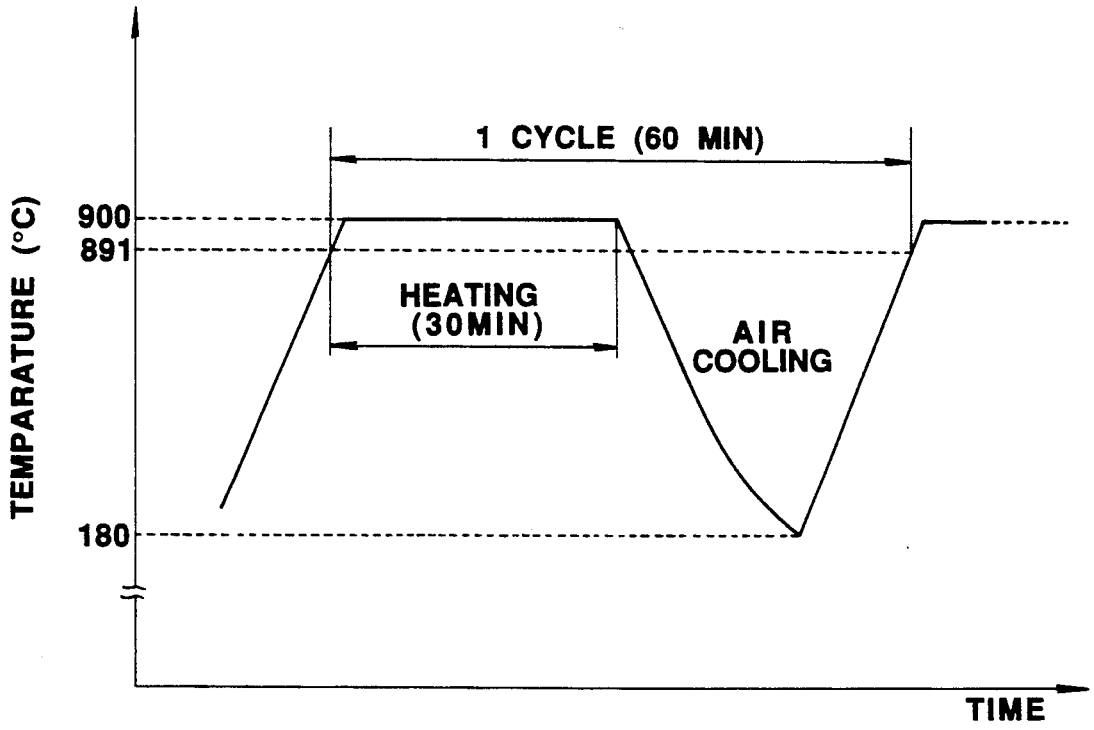
FIG. 2 is a graph showing the thermal cyclic pattern applied on specimens in the oxidation resistance test.

Heating-cooling pattern: repeating cooling down to 180° C. after heating up to 900° C. and maintaining for 30 minutes as shown in FIG. 2.

TABLE 1

| No. | Chemical composition (wt %) Al | Si | Nb | Ti | Oxidation gain ($g/m^2$) |
|---|---|---|---|---|---|
| Example | | | | | |
| 1 | 30.3 | 0.13 | 0.15 | Bal. | 92 |
| 2 | 30.1 | 1.8 | 4.7 | Bal. | 46 |
| 3 | 33.8 | 0.11 | 0.13 | Bal. | 96 |
| 4 | 33.3 | 0.12 | 4.7 | Bal. | 66 |
| 5 | 33.4 | 1.8 | 0.12 | Bal. | 61 |
| 6 | 33.2 | 1.9 | 4.8 | Bal. | 27 |
| 7 | 33.5 | 0.3 | 0.5 | Bal. | 43 |
| 8 | 33.1 | 1.0 | 0.9 | Bal. | 33 |
| 9 | 35.8 | 0.3 | 0.4 | Bal. | 21 |
| 10 | 41.7 | 0.15 | 0.14 | Bal. | 43 |
| 11 | 41.7 | 1.9 | 4.7 | Bal. | 16 |
| Comparative Example | | | | | |
| 1 | 30.5 | — | — | Bal. | 493 |
| 2 | 33.6 | — | — | Bal. | 413 |
| 3 | 36.2 | — | — | Bal. | 235 |
| 4 | 42.0 | — | — | Bal. | 214 |

Figure 3:
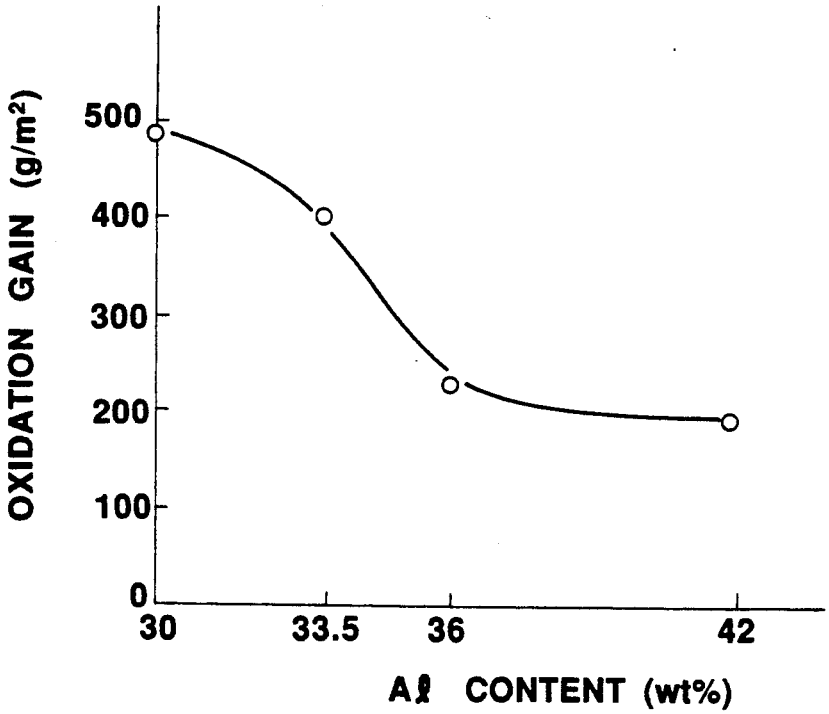
FIG. 3 is a graph showing the relationship between the Al content and the oxidation gain obtained through the oxidation resistance test.

FIG. 3 shows the relationship between the Al content and the oxidation gain obtained from the results shown in Table 1. and Table 2 shows the effect of Si and Nb contained in the Ti-Al based material by rearranging the results shown in Table 1 so as to make easy to understand.

TABLE 2

| Si and Nb contents | Ratio of oxidation gain against that of Si and Nb-free material |
|---|---|
| 0.1 Si—0.1 Nb | ¼ ~ 1/5 |
| 0.1 Si—5 Nb | 1/6 ~ 1/7 |
| 2 Si—0.1 Nb | 1/6 ~ 1/7 |
| 0.3 Si—0.5 Nb | 1/10 ~ 1/11 |
| 1 Si—1 Nb | 1/13 |
| 2 Si—5 Nb | 1/11 ~ 1/15 |

As apparently from their results, the oxidation gain decreases remarkably in a state in which Si and Nb coexist. When Si and Nb are contained independently, the inhibitive effect against the oxidation gain is insufficient as described above. For example, the oxidation gain is about one-third the case of Si-free when Si is contained up to 3%, and the oxidation gain is about one-fourth the case of Nb-free when Nb is contained up to 1%.

Althrough examples according to this invention has been described in detail, this is only one instance, therefore this invention may be made in the form given with various changes according to the knowledge of those skilled in the art without departing from the spirit of this invention.

What is claimed is:

1. A ti-Al based lightweight-heat resisting material comprising by weight 30 to 425 of Al, 0.1 to 2% of Si, 0.1 to 0.4% of Nb and the balance being substantially Ti.

2. The Ti-Al based lightweight-heat resisting material as in claim 1, wherein Al is present in an amount of 31 to 36% by weight.

3. The Ti-Al based lightweight-heat resisting material as in claim 1, wherein Si is present in an amount of 0.2 to 11% by weight.

4. The Ti-Al based lightweight-heat resisting material as in claim 1, wherein Al is present in an amount of 31 to 36% by weight and Si is present in an amount of 0.2 to 1% by weight.

* * * * *